United States Patent [19]

Gamble

[11] Patent Number: 4,989,881

[45] Date of Patent: Feb. 5, 1991

[54] ILLUMINATED SPORTS PROJECTILE

[76] Inventor: Christopher L. Gamble, P.O. Box 9154, Canoga Park, Calif. 91309

[21] Appl. No.: 316,912

[22] Filed: Feb. 28, 1989

[51] Int. Cl.[5] ..... A63B 65/02

[52] U.S. Cl. ..... 273/416; 362/110

[58] Field of Search ..... 273/416, 419, 420, 423, 273/DIG. 24; 446/242; 362/110

[56] References Cited

U.S. PATENT DOCUMENTS

| | | | |
|---|---|---|---|
| 3,803,757 | 4/1974 | Sanchez | 446/242 |
| 3,804,411 | 4/1974 | Hendry | 273/DIG. 24 X |
| 3,917,264 | 11/1975 | Davidson et al. | 273/DIG. 24 X |
| 4,006,556 | 2/1977 | Williams | 446/242 |
| 4,015,111 | 3/1977 | Spector | 273/DIG. 24 X |
| 4,086,723 | 5/1978 | Strawick | 273/DIG. 24 X |
| 4,340,930 | 7/1982 | Carissimi | 273/416 X |
| 4,547,837 | 10/1985 | Bennett | 362/110 X |
| 4,695,055 | 9/1987 | Newcomb et al. | 273/DIG. 24 X |
| 4,715,564 | 12/1987 | Kinn et al. | 446/219 X |
| 4,717,158 | 1/1988 | Pennisi | 273/DIG. 24 X |
| 4,840,383 | 6/1989 | Lombardo | 273/420 |

FOREIGN PATENT DOCUMENTS

| | | | |
|---|---|---|---|
| 2519558 | 7/1983 | France | 273/DIG. 24 |
| 589629 | 6/1964 | United Kingdom | 273/416 |
| 2007989 | 5/1979 | United Kingdom | 273/420 |
| 2029711 | 3/1980 | United Kingdom | 273/416 |

*Primary Examiner*—Paul E. Shapiro

*Attorney, Agent, or Firm*—Gregory J. Nelson

[57] ABSTRACT

A dart has a barrel with a compartment having an LED therein, a tail and a point section at opposite ends of the barrel. One of the tail and point sections is detachable fromn the body and defines a recess with a battery therein. A first pair of contacts on the barrel are connected to the LED by a pair of wires, and a second set of contacts in the recess connect with the first pair when the sections and barrel are assembled to activate the LED.

1 Claim, 1 Drawing Sheet

LED

ILLUMINATED SPORTS PROJECTILE

The present invention relates to a sports article and more particularly to a projectile type sports article for launching or hand-throwing by the user which article is illuminated.

Darts is a very popular game, particularly in Britain and in the United Stares. Darts is also a very challenging game involving both mental and physical skills which accounts for its popularity and growth. In the classic English dart game, the object is to reduce the player's score from 301 to precisely zero using as few darts as possible, starting on a double and finishing on a double. The player must throughout the game calculate the score and determine the strategy to best achieve the desired goal. The physical aspects of the game require a throwing arm that has precise guided direction of movement with smooth elbow and wrist pendular motions together with and acceleration followed by release of the dart at the appropriate time. A skilled dart thrower can consistently hit the desired target location on the dart board. The dart board most used is the English dart board with twenty radially extending pie-shaped segments with an inner and outer bull ar the center of the board. Double and triple rings are concentrically positioned about the inner bulls.

The game of darts can be played as a recreational game and is often played in taverns and pubs. At the more serious level, tournament play with substantial prize money and purses is also available.

The size, shape and construction of the dart used varies considerably in accordance with the personal preference of the darter. Dart barrels originally were made from wood, however, wood was later replaced with brass since brass could be easily fabricated into a variety of barrel styles and shapes. In recent years, various alloys of nickel, copper and tungsten have been used to produce even slimmer barrels. A slimmer barrel is often preferred to improve the grouping of the darts in a tight space. The dart shaft can be made of plastic or wood and the length and weight of the shaft may vary. The shaft length determines the distance of the flight from the barrel which establishes the center of gravity of the dart and aerodynamic characteristics. Shafts may be made of wood, plastic, aluminum or fiberglass. The flights serve as an air foil and may be made from various materials such as natural feathers, polyester or plastic.

Because darters are continually seeking new and innovative ways to both improve their game and to add a personal element to the game, darts as indicated, may rake various shapes and be made of various materials and may be colored and decorated to the taste of the individual. Accordingly, the present invention provides an improved projectile sports article such as an arrow or dart, which is lighted or illuminated to enhance and increase the enjoyment of the participants. Further, the illumination of the projectile allows each player to select the color of his or her choice which illuminated dart is highly visible both during its flight and its position on the board which will add to the enjoyment and excitement of the game and make scoring the game easier. The illumination of the object will also make locating the projectile easier, particularly in the case of an errant toss.

The present invention relates to an illuminated sport article, such as a dart or arrow, which has an elongate body which houses a source of illumination. With the preferred embodiment, the body contains compounds which, when activated, produce chemiluminescent illumination for an extended period of time. The compounds are of the type that are contained in a compartmented ampule or container which, upon use, is partially ruptured to cause the compounds to mix resulting in a chemical reaction providing the chemiluminescent illumination.

In one embodiment, the barrel or body of the dart or arrow forms the compartment and pressure is applied to the body to cause the compounds to mix and a reaction to occur.

In another embodiment, the barrel is hollow and the self-contained chemiluminescent device is activated and inserted in the hollow body of the barrel.

In other embodiments, the body is internally coated with a phosphorescent or reflective material which will provide a luminescent glow under appropriate light.

In still another embodiment, a light emitting means is positioned within the hollow interior of a transparent barrel of the projectile to provide illumination when the dart or object is thrown. Appropriate power source and electrical connections are contained within the hollow barrel of the dart or other object.

Other features and advantages of the invention will become more readily apparent from the following detailed description of the invention taken in conjunction with the accompanying drawings in which.

Figures 1, 2, 3, 4, 5, 6:
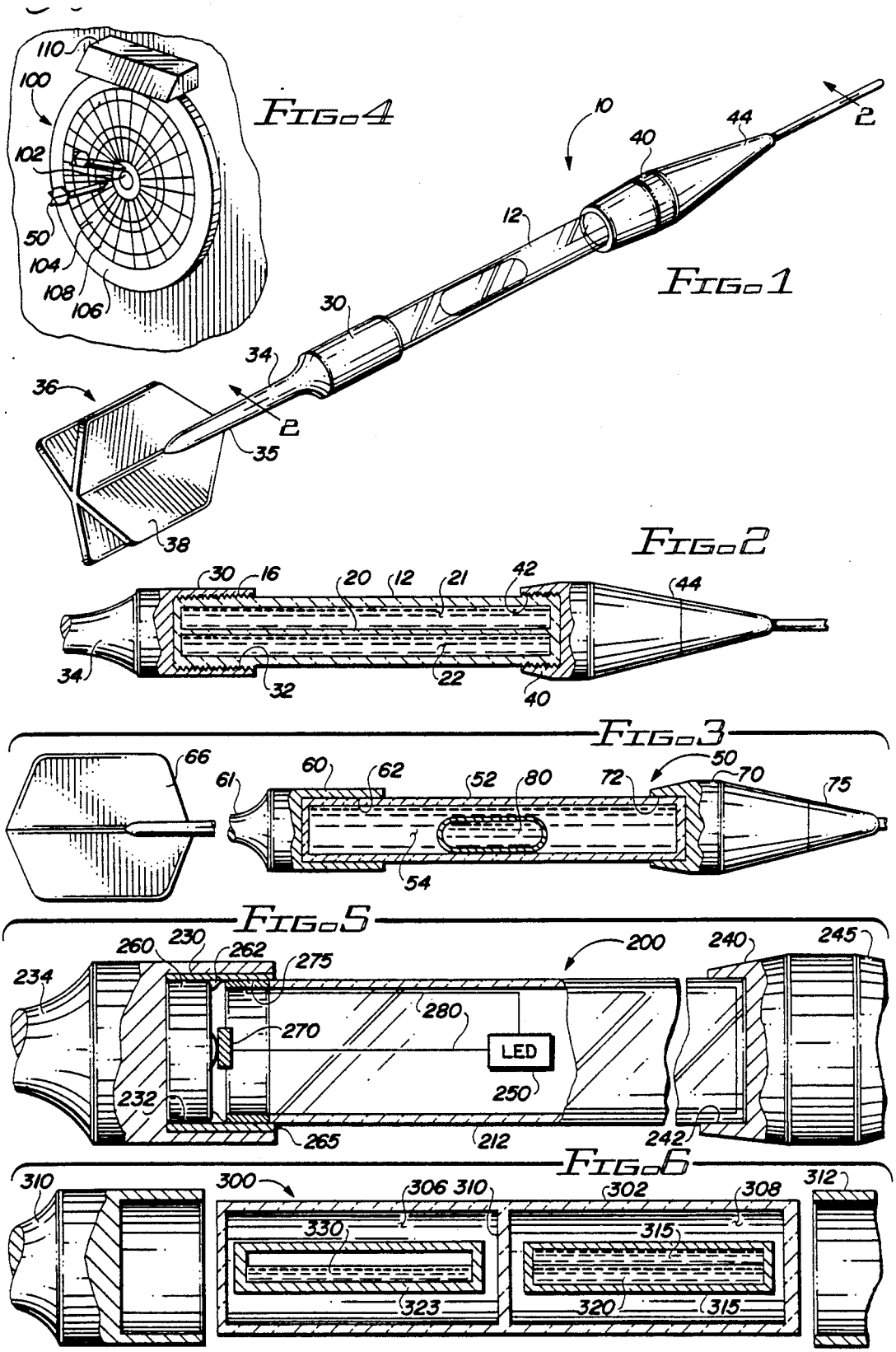
FIG. 1 is a perspective view of a preferred embodiment of the dart or projectile of the present invention.
FIG. 2 is a sectional view taken along lines 2—2 of FIG. 1 illustrating the chemical container within the barrel of the dart or projectile.
FIG. 3 is a view partly in section of another embodiment of the present invention.
FIG. 4 is a view showing a plurality of the darts of the present invention embedded in a conventional dart board which is illuminated with black light for increasing the visibility of the darts.
FIG. 5 is a detail sectional view of still another embodiment of the present invention utilizing an LED as the source of illumination.
FIG. 6 is perspective view of the elongate body of still another embodiment of the dart or projectile of the present invention.

Referring to FIGS. 1 and 2, a projectile adapted for throwing or launching is shown and generally designated by the numeral 10. Throughout the specification, the invention will, for purposes of clarity and convenience, be described with reference to a dart. It is to be understood that the invention pertains to various types of sports projectiles such as darts, arrows and the like. Dart 10 includes a generally elongate tubular barrel 12. The barrel is a semi-rigid translucent material such as polyethylene, polypropylene or an acrylic. The barrel defines an interior chamber which is divided by longitudinally extending wall 20 into compartments 21 and 22. Wall 20 is of a material having less flexibility than the external barrel 12 so that when the barrel 12 is twisted or bent by application of manual pressure, the wall 20 will rupture causing the chemicals in compartments 21 and 22 to mix and interact as will be explained.

In the embodiment of FIGS. 1 and 2, the visible light emitting from the body of the projectile is preferably chemiluminescent from a chemical reaction of chemicals in the presence of a fluorescent compound. The barrel is a material which is light-transmitting and which contains the light-producing components in the separated compartments 21 and 22. For example, a chemiluminescent material and a diluent are in compartment 21. The adjacent compartment 22 contains a fluorescent and hydrogen peroxide. The compartments are separated by the rupturable wall 20. When it is desired to use the device, external pressure is applied to the body as seen in FIG. 2 which ruptures the wall to permit mixing of the components causing the reaction to occur and the production of chemiluminescent light. The transparent body or barrel 12 then constitutes a self-contained light source which may be of selected color and which lasts for several hours. The generation of light through such type chemical reaction is known and is discussed and described in detail in U.S. Pat. Nos. 3,539,794 and 3,597,362. Devices of this type are commercially available and known to those skilled in the art. One type is sold under the designation "Cyalume" lightstick.

The elongate barrel 12 which contains the source of illumination is shown as having threaded portions 14 and 16 at opposite ends as seen in FIG. 2. At the rear of the barrel, a cylindrical sleeve 30 of plastic or metal has internally threaded portions 32 which are cooperable with threads 16 on the body. A shaft 34 extends rearwardly from sleeve 30 tapering to define a rail section 35. The tail section 35 is provided with a plurality of elongate slots which receive a flight 36 consisting of a plurality of wings 38 to provide aerodynamic stability to the dart when thrown.

The forward end of the barrel is securable to sleeve 40 which has internal threads 42 cooperable with external threaded portion 14 at the forward end of the barrel. A point 44 extends from the sleeve and tapers as shown to a sharpened tip. The point may be a sharpened metal as is conventional or may be a plastic material of the type usable with electronic dart boards which have a more porous composition allowing the use of the softer, safety points. The point 44 may be in threaded engagement with the sleeve 40 so different points may be attached at the preference of the user.

In use, sleeve 30 and attached shaft 34 are engaged at the threads 16 of selected barrel 12. Similarly, the sleeve 40 and the forwardly extending point 44 is also placed in threaded engagement at the forward end of the selected barrel ar threads 14.

In use, the players each select a barrel that will emit a different color light. This makes scoring, locating and identification of each player's dart more convenient. The barrel is assembled to the shaft and point as described above. Pressure is applied to the barrel causing the internal wall 20 to rupture initiating the chemical reaction that results in the emission of chemiluminescent light. Typically, the reaction will continue for a number of hours sufficient for the duration of the game.

The dart of the present invention is used in a conventional manner as for example with the darter using the thumb, index finger and middle finger to grip the dart. The forearm, wrist and hand are accelerated forwardly and the dart is released in a smooth motion toward the target. Inasmuch as dart games and competitions are often held in recreation rooms, taverns and pubs where lighting is low, the phosphorescent glow emitted from the body of the dart will be highly visible, attractive and add an element of interest to the game. The illuminated darts will also assist in keeping track of the score, particularly if each player selects a dart barrel which emits a different color.

FIG. 3 shows another embodiment of the invention generally designated by the numeral 50. In this embodiment, the dart has an elongate tubular barrel 52 defining a cylindrical chamber 54. The barrel 80 is of a suitable translucent, transparent or other material permitting passage of light. A sleeve 60 defines a recess 62 which can be slipped over the rear end of the barrel to frictionally engage the rear end of the barrel. Sleeve 60 has a shaft portion 64 extending rearwardly which carries flight 66. Shaft 64 is preferably transparent or translucent so the light-emitting source will be visible through this section as well as the barrel.

Sleeve 70 is provided at the forward end of the dart which defines a recess 72 which frictionally engages the front end of the barrel 52. Sleeve 70 carries a forwardly extending point 75.

The hollow compartment 54 in the barrel contains light-emitting means 80. Light-emitting means may be in the form of an internal phosphorescent or light-reflecting coating on the interior wall of the barrel or may be an insert 80 as shown. Insert 80 may be a piece of paper or other flexible material suitably coated with phosphorescent material which is rolled and inserted within the barrel. The light-emitting means may also be an insertable, self-contained chemiluminescent device of the type described above which upon application of pressure is activated. The dart is assembled by engaging sleeve 60 at the rear end of the barrel and sleeve 70 at the forward end of the barrel after the light-emitting device has been installed in the barrel.

When the projectile or dart 50 is used in an environment where ultra violet or black light exists, the light-emitting element 80 will glow or will glow with greater intensity providing the desired illuminated effect both during flight and when the dart is on the target.

Referring to FIG. 4, the effect of the illumination will be increased when the target area is bathed in black light. In FIG. 4, a conventional English-style dart board 100 is shown having the usual bullseye 102, segments 104 and double and triple areas 106 and 108. A source of black light 110 is positioned adjacent the target to illuminate the target and the area adjacent the target with black light to enhance the illumination effect of the darts.

Another embodiment of the present invention is shown in FIG. 5 and is generally designated by the numeral 200. The projectile or dart of this embodiment has an elongate tubular barrel 212 having forward and rear ends. The rear end of the barrel is detachably securable to a sleeve 230 having a recess 232 therein. A tail portion 234 extends rearwardly from the sleeve and receives a flight as has been described. Sleeve 240 defines a recess 242 which frictionally engages the forward end of the barrel. A point 245 extends forwardly from the sleeve.

A light-emitting source 250, which in the embodiment is shown a light-emitting diode, is incorporated within the body 212. Recess 230 is of sufficient depth and is dimensionally configured to receive a power source 260 which is typically a disk-shaped, low-profile battery. The battery is a button cell-type commonly used for various electronic devices such as cameras. The battery is simply pressed into the recess and retained by a suitable flexible flange or projection 262. A conductive ring 265 extends within the recess circumferentially about the power source.

The tail end or rear end of the body is provided with a receiving means which include a first or base contact 270 and an annular outer or second contact 275 as seen in FIG. 5.

The barrel is typically molded by injection molding fabrication techniques. At the time of molding, light-emitting diode 250, wire pair 280 and contacts 270, 275 are suitably positioned within the mold and the material is formed around these components under pressure. Thus, the barrel, light-emitting diode and contacts are formed as an integral part in a single operation at rapid, low cost.

When the dart or projectile is to be used, the point 245 is secured to the forward end of the barrel by frictionally engaging sleeve 240 over the forward end of the barrel. The shaft and sleeve are assembled by first inserting power source 260 into the recess. Sleeve 230 is then slipped over the rear of the barrel completing the circuit between the power source and light-emitting diode 250. As the dart travels, the light-emitting diode creates the effect of a line of light as the object moves toward the target. Further, the illumination of the dart when engaged at the dart board make it easier for the participants to score the game as the location of the darts of the participants are readily discernable.

It will be noted that the components of the dart such as the shaft, barrel and point can be variously configured and shaped to the requirements of the individual so that the dart has the desired flight characteristics.

FIG. 6 illustrates another embodiment of the present invention designated by the numeral 300. In FIG. 6 the barrel 300 of the dart is shown again as being generally tubular defining a cylindrical hollow interior. The material of the tube is preferably a transparent plastic and is detachably secured to a point 312 and a shaft 310, as has been described above. The hollow interior is divided or partitioned into a front and rear compartment 306 and 308 respectively by partition 310. The forward compartment 308 is adapted to receive a source of illumination which may be an ampule or container 315 containing suitable components 320 which will emit chemiluminescent light. The container may be activated prior to insertion into the chamber 308 and once inserted point 312 frictionally engaged at the front end of the barrel. The rear chamber 306 contains a small elongate cylinder 325 having an axially extending hollow interior 330. The capsule 325 is sealed with the hollow interior containing a small amount of material 330 having high specific density. A drop of mercury is suitable for this purpose.

When the barrel is assembled into a completed projectile or dart, the forward compartment will serve to provide illumination during the flight of the dart and otherwise during the dart game. The capsule 325 at the rear of the dart provides a stabilizing effect. As the dart is released from the hand of the user as the forearm forwardly accelerates, the mercury 350 will tend to move rearwardly within the compartment 325. This rearward movement of the weight member will tend to cause the tip of the arrow to remain horizontal improving the flight characteristics of the projectile. Upon impact, the weight member will accelerate forwardly tending to solidly drive the point into the target.

Thus, it will be seen that the present invention provides a unique and novel illuminating projectile especially suitable for darts, arrows and similar projectiles used in various sport activities. It will be obvious to those skilled in the art to make various changes, alterations and modifications to the sport projectile of the present invention, to the extent such changes, alterations and modifications do not depart from the spirit and scope of the appended claims. They are intended to be encompassed therein.

I claim:

1. A dart for throwing at a target in a game area comprising:

(a) a generally elongate barrel with opposite ends having a light transmitting area and defining a compartment therein;

(b) a tail section and a point section at opposite ends of said barrel, at least one of said sections being detachable from said barrel to provide access to said compartment; and (c) light emitting means in said compartment comprising an LED and a power source, at least one of said tail and point sections defining a recess, said power source including a battery in said recess, first and second contact means in said recess, third and fourth contact means associated with said barrel and connected via a wire pair to said LED, said first and second contacts respectively being in electrical connection with said third and fourth contacts when said sections and barrel are assembled to selectively activate said LED.

* * * * *